US009675509B2

(12) United States Patent
Tilk et al.

(10) Patent No.: US 9,675,509 B2
(45) **Date of Patent: *Jun. 13, 2017**

(54) PATIENT TRANSFER ASSEMBLY

(71) Applicant: Nottingham Spirk Design Associates, Cleveland, OH (US)

(72) Inventors: Jason Tilk, Cleveland Heights, OH (US); William Rabbitt, Chesterland, OH (US); Rebecca Blice, Akron, OH (US)

(73) Assignee: NOTTINGHAM SPIRK DESIGN ASSOCIATES, Cleveland, OH (US)

( * ) Notice: Subject to any disclaimer, the term of this patent is extended or adjusted under 35 U.S.C. 154(b) by 31 days.

This patent is subject to a terminal disclaimer.

(21) Appl. No.: 14/611,456

(22) Filed: Feb. 2, 2015

(65) Prior Publication Data

US 2016/0089288 A1 Mar. 31, 2016

Related U.S. Application Data

(60) Provisional application No. 62/057,208, filed on Sep. 29, 2014.

(51) Int. Cl.
*A61G 7/10* (2006.01)
*B65D 33/06* (2006.01)

(52) U.S. Cl.
CPC ..... *A61G 7/1026* (2013.01); *A61G 7/1036* (2013.01); *A61G 7/1046* (2013.01); (Continued)

(58) Field of Classification Search
CPC ..... A61G 7/10; A61G 7/1023; A61G 7/1025; A61G 7/1026; A61G 7/103; A61G 7/1038;
(Continued)

(56) References Cited

U.S. PATENT DOCUMENTS 4,679,520 A * 7/1987 Harken ..... B63H 9/1042 114/104
4,744,115 A * 5/1988 Marchione ..... 5/81.1 T
(Continued)

FOREIGN PATENT DOCUMENTS

EP 2 415 444 2/2012

OTHER PUBLICATIONS

Youtube, Thermarest ProLite Stuff Sack (Pomegranate), https://www.youtube.com/watch?v=NICIGYyDc40, Published May 27, 2013.*

(Continued)

*Primary Examiner* — David E Sosnowski
*Assistant Examiner* — Myles Throop
(74) *Attorney, Agent, or Firm* — Renner, Otto, Boisselle & Sklar, LLP.

(57) ABSTRACT

A method of transferring a patient from a first resting surface to a second resting surface includes inserting a corrugated sheet into a channel formed between the patient and the first resting surface, extending a portion of the sheet between the patient and the first resting surface to under the patient's feet, extending a portion of the sheet between the patient and the first resting surface to under the patient's head, and pulling laterally on the sheet to slide the sheet from the first resting surface to the second resting surface thereby transferring the patient.

7 Claims, 16 Drawing Sheets

(52) U.S. Cl.
CPC ..... *A61G 7/1048* (2013.01); *B65D 33/06* (2013.01); *B65D 33/065* (2013.01); *A61G 2200/327* (2013.01)

(58) Field of Classification Search
CPC .. A61G 7/1074; A61G 7/1001; A61G 7/1013; A61G 1/00; A45F 3/22; A47G 9/00; A47G 9/06
USPC ..... 5/81.1 HS
See application file for complete search history.

(56) References Cited

U.S. PATENT DOCUMENTS 4,908,247 A * 3/1990 Baird et al. ..... 428/34.9
5,119,750 A * 6/1992 Somers ..... B63H 9/08 114/104
5,317,770 A * 6/1994 Sakurai ..... A61G 7/0504 5/625
5,570,482 A * 11/1996 Asakawa ..... A61G 7/1015 5/81.1 C
5,577,281 A * 11/1996 Mital et al. ..... 5/625
5,737,781 A 4/1998 Votel
5,890,238 A 4/1999 Votel
D435,493 S 12/2000 Jewell et al.
6,341,393 B1 1/2002 Votel
6,374,435 B1 * 4/2002 Leininger et al. ..... 5/81.1 HS
6,378,148 B1 4/2002 Votel
6,578,507 B1 * 6/2003 Bergmark ..... B63B 1/322 114/272
6,834,402 B2 12/2004 Hanson et al.
7,114,203 B2 10/2006 Lloyd et al.
7,458,113 B2 12/2008 Milam
7,506,387 B1 3/2009 Scordato et al.
7,571,498 B2 8/2009 Jewell et al.
2004/0123382 A1 * 7/2004 Berge ..... 5/81.1 HS
2005/0177942 A1 * 8/2005 Finn ..... 5/499
2006/0076186 A1 * 4/2006 Lindqvist ..... B63C 9/26 182/70
2009/0045383 A1 * 2/2009 King et al. ..... 254/93 HP
2010/0235986 A1 9/2010 Klyne et al.
2013/0025048 A1 1/2013 Pruett
2013/0180046 A1 * 7/2013 Davis, Jr. ..... 5/81.1 HS
2013/0205495 A1 * 8/2013 Ponsi et al. ..... 5/81.1 HS
2013/0227789 A1 * 9/2013 Olson et al. ..... 5/625
2015/0007832 A1 * 1/2015 Jensen ..... A61G 1/013 128/870

OTHER PUBLICATIONS

AirPal Lateral Patient Transfer Device Product Brief; May 28, 2014.
HoverMatt Air Transfer System User Manual; Jun. 2013.
Stryker Glide Lateral Air Transfer System Spec Sheet; 2009 (see Note 1 on p. 1 of IDS).
EZ Matt Air Assisted Lateral Transfers; Jan. 17, 2005.
Liftaem Lateral Patient Transfer Device; Jul. 9, 2014.
Sally Tube Single Patient Use Slide Tubes Brochure (see Note 1 on p. 1 of IDS).
The Pink Slip Slide Sheet, Product Information (see Note 1 on p. 1 of IDS).
Ayala, Heidi, et al., "Minimizing Collateral Damage: Reducing the Risks Associated with Patient Handling"; Air-Assisted Lateral Patient Transfer; Jan. 2010.
TotalCare Bariatric Plus Hospital Bed Brochure; Aug. 8, 2013.
Camtec Care Chair Manual; Apr. 3, 20016.
"Health and Economic Benefits of Improving Mobility for the Bedridden Patient at Home"; Next Health Inc., AgileLife Patient Transfer System; May 2011.

* cited by examiner

PATIENT TRANSFER ASSEMBLY

FIELD OF THE INVENTION

The present disclosure relates generally to the field of medical devices. In particular, the present disclosure relates to a patient transfer assembly.

BACKGROUND

According to the recent data from the United States Bureau of Labor Statistics, health care workers suffer injuries and illnesses at nearly twice the national average rate. Hospitals had an incidence rate of 6.8 nonfatal occupational injuries and illnesses per 100 full-time workers in 2011, compared with 3.5 per 100 in all U.S. industries combined. Nearly 50 percent of the reported injuries and illnesses among nurses and nursing support staff in 2011 were musculoskeletal disorders. Nursing assistants suffered more of these disorders in 2011 than any other occupation, while registered nurses ranked fifth.

A significant part of the problem is that health care workers at hospitals, nursing homes, and home care programs face the challenge of moving partly or completely incapacitated patients. A typical patient weighs between 100 and 200 pounds, although many others weigh more. Consequently, moving a patient often requires two, three or even four health care workers. Current healthcare guidelines typically recommend that four health care workers participate in a patient transfer. These activities often create unacceptable risks of injury regardless of the number of health care workers involved in the patient transfer. The risks are even higher when a sufficient number of workers is not available to assist in a patient transfer. The costs of these injuries are significant. For example, injuries to workers' backs account for approximately 50% of worker's compensation costs for work place injuries in the health care industry in the U.S. Thus, back injuries to health care workers are a particularly vexing problem.

Patient transfer devices have been proposed to deal with the problem. Prior art devices, however, have shortcomings. In some proposed devices, the surface on which the patient rests does not cooperate or opposes the transfer because of friction, etc. Other times, the means (e.g., hospital sheets) for engaging the patient for movement are not effective or difficult to engage.

SUMMARY OF THE INVENTION

The invention relates to devices, systems and methods to assist in moving patients who are partly or completely incapacitated. The invention more particularly relates to devices, systems and methods that give a single health care worker the ability of moving a patient from one bed to another bed, between a bed and a cart or gurney or repositioning the patient within a bed regardless of the weight and/or size of the patient.

These and further features of the present invention will be described with reference to the attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the terms of the appended claims.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
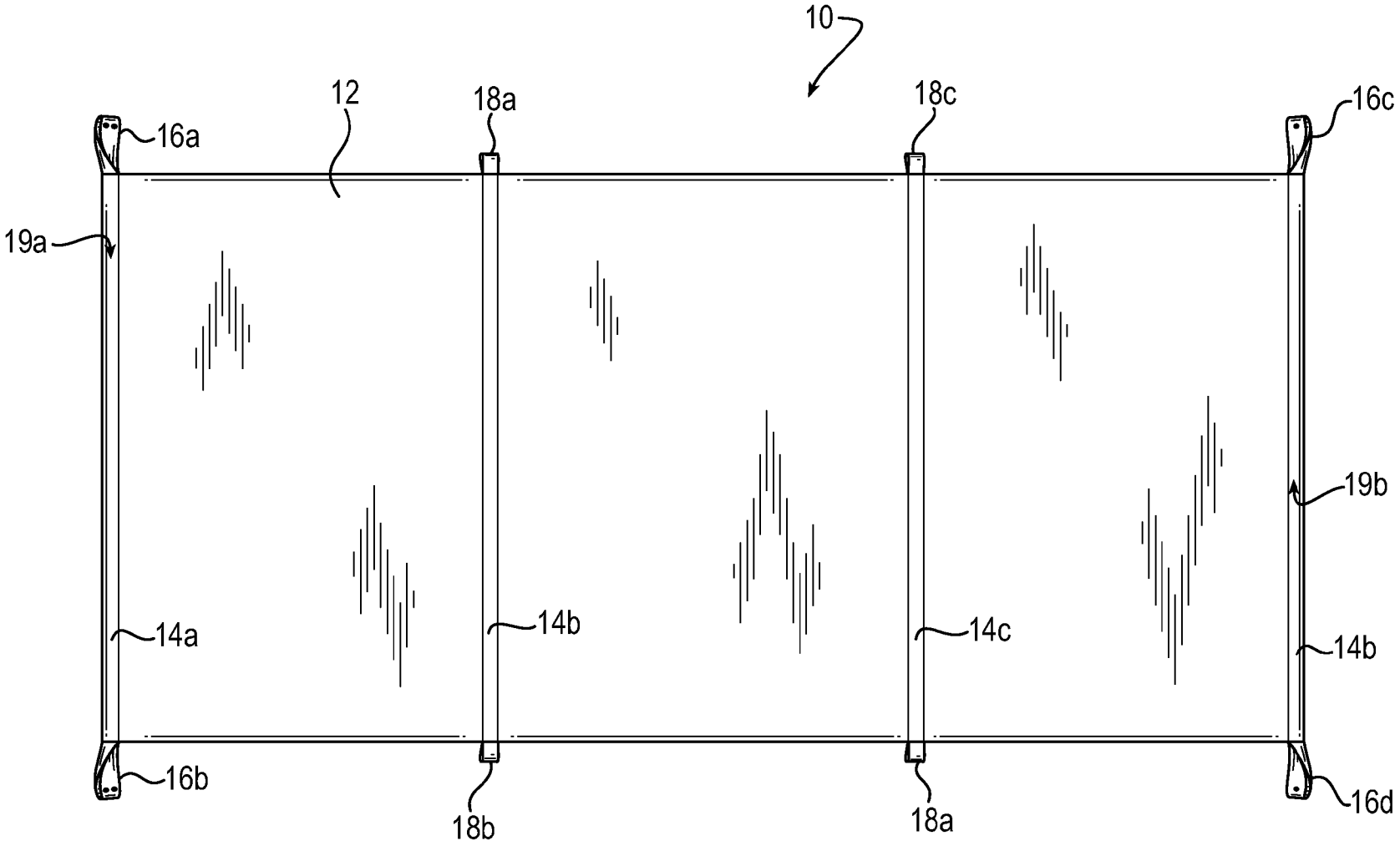
FIG. 1 illustrates a top view of an exemplary patient transfer assembly.

FIG. 1 illustrates an exemplary patient transfer assembly 10. As explained below, the patient transfer assembly 10 is insertable under a patient resting on a surface so that the patient may be easily transferred from that surface. The patient transfer assembly 10 includes a sheet 12 that is constructed of a material that has a relatively low coefficient of drag or friction (i.e., the material is slippery) and that is foldable or corrugatable. For example, the sheet 12 may be constructed of nylon, silicon coated nylon, Tyvek®, etc.

In the illustrated embodiment, the patient transfer assembly 10 includes webbings or straps 14*a-d* spaced over the length of the sheet 12. The straps 14*a-d* may be attached (e.g. sewn) to the sheet 12 to reduce friction. The patient transfer assembly 10 also includes handles 16*a-d* connected to the ends of the sheet 12 or to ends of the straps 14*a* and 14*d* as shown in FIG. 1. The patient transfer assembly 10 further includes fasteners 18*a-d* connected to the sides of the sheet 12 or to ends of the straps 14*b* and 14*c* as shown in FIG. 1.

Figure 2A:
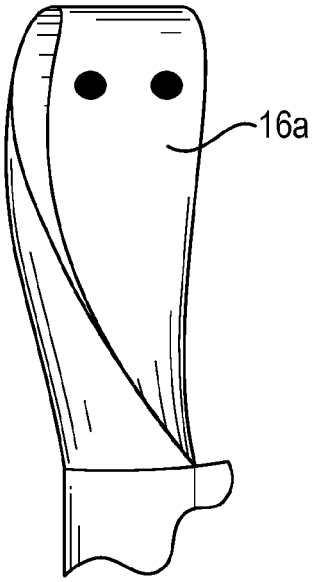
FIGS. 2A and 2B illustrate perspective views of exemplary handles of the patient transfer assembly of FIG. 1.
Figure 2B:
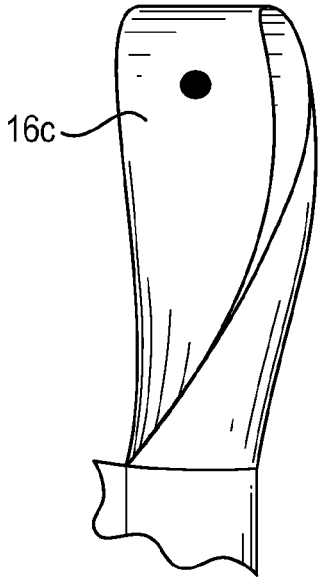
Figure 3:
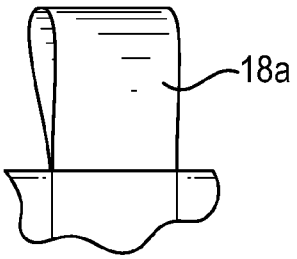
FIG. 3 illustrates a perspective view of an exemplary fastener of the patient transfer assembly of FIG. 1.

FIGS. 2A and 2B illustrate exemplary handles 16*a* and 16*c*, respectively. In the illustrated embodiment, the handles 16*a-d* are shown as loops, but the handles 16*a-d* may correspond to handles other than loops. FIG. 3 illustrates exemplary fastener 18*a*. In the illustrated embodiment, the fasteners 18*a-d* are shown as loops, but the fasteners 18*a-d* may correspond to fasteners other than loops.

Returning to FIG. 1, the patient transfer assembly 10 includes stiffeners 19*a-b*. In the illustrated embodiment, the stiffeners 19*a-b* are located at ends of the sheet 12 and are inside pockets formed on the sheet 12. The patient transfer assembly 10 may include a single stiffener or multiple stiffeners. In one embodiment, a single or multiple stiffeners may be located at locations of the sheet 12 different from the ends (e.g., the middle) or the stiffeners may be non-attached or removable from the sheet 12. The stiffeners 19*a-b* may be rods or poles constructed from rigid or semi-rigid material (e.g., wood, plastic, etc.). As described in more detail below, the stiffeners 19*a-b* resist corrugation of the sheet 12 along a dimension of the sheet.

Figure 4A:
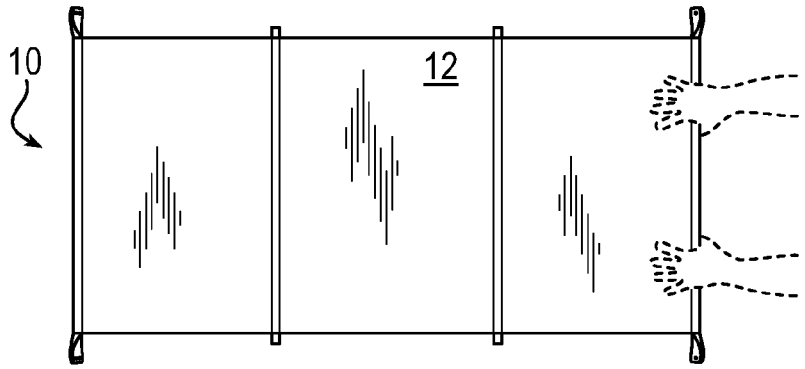
FIGS. 4A-4L illustrate an exemplary method for corrugating a sheet of the exemplary patient transfer assembly of FIG. 1.
Figure 4B:
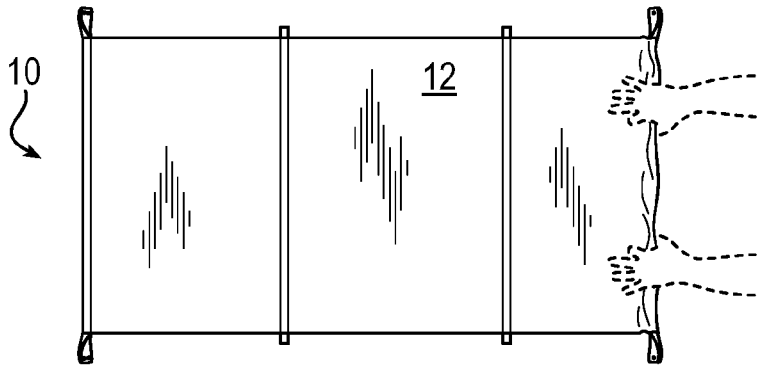
Figure 4C:
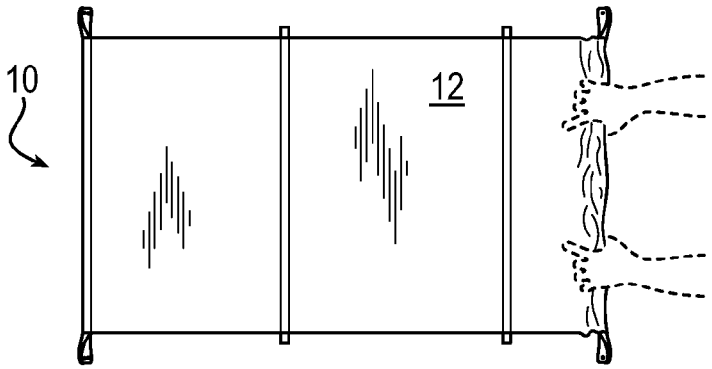
Figure 4D:
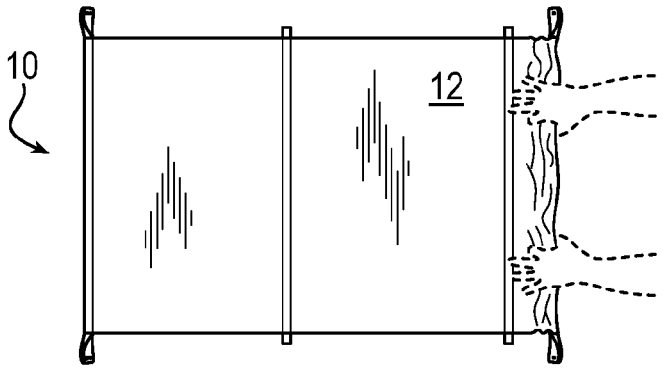
Figure 4E:
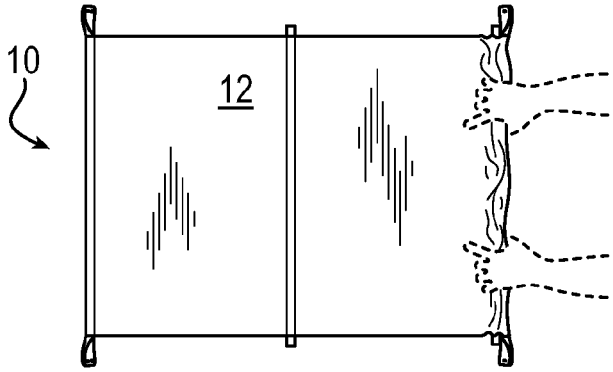
Figure 4F:
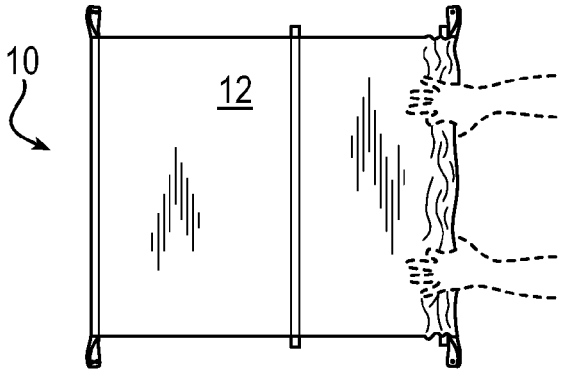
Figure 4G:
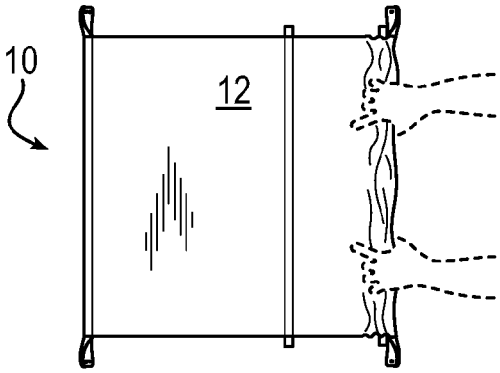
Figure 4H:
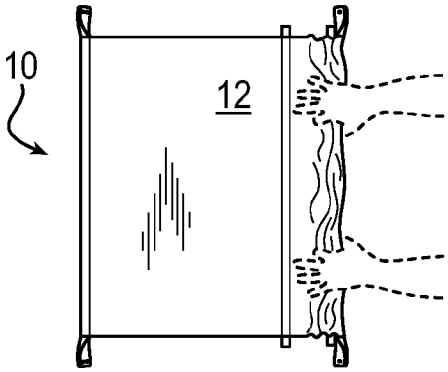
Figure 4I:
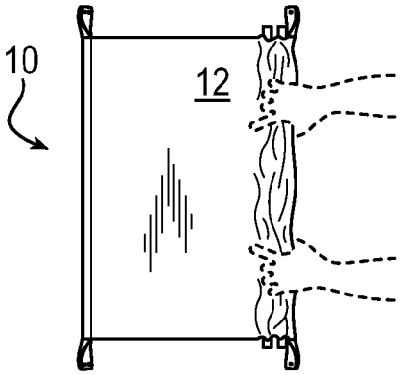
Figure 4J:
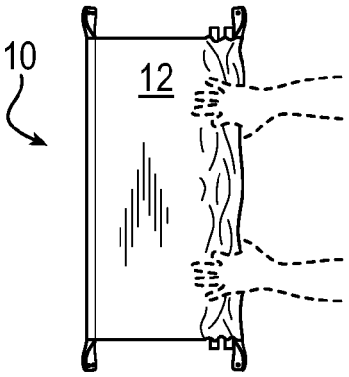
Figure 4K:
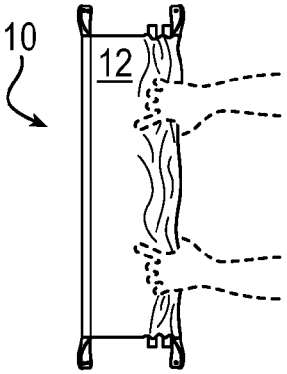
Figure 4L:
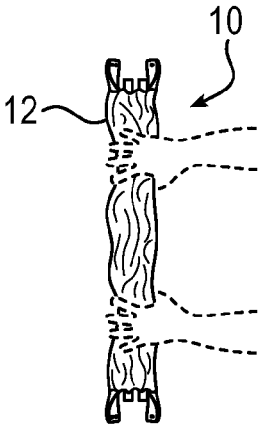
Figure 4M:
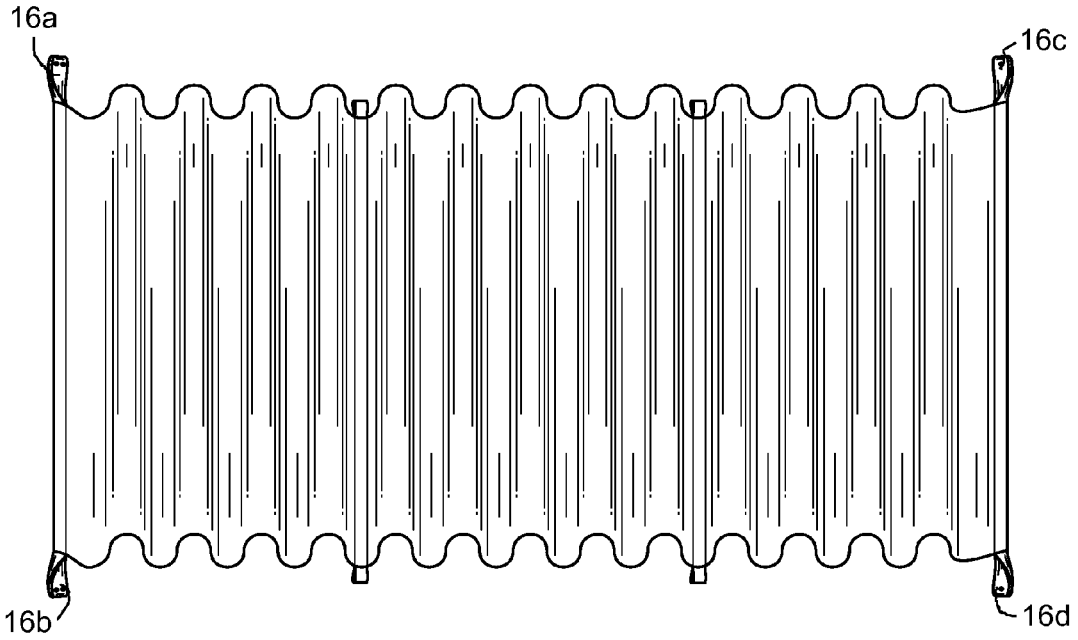
FIGS. 4M-4N illustrate exemplary corrugation methods for the corrugated sheet of FIGS. 4A-4L.
Figure 4N:
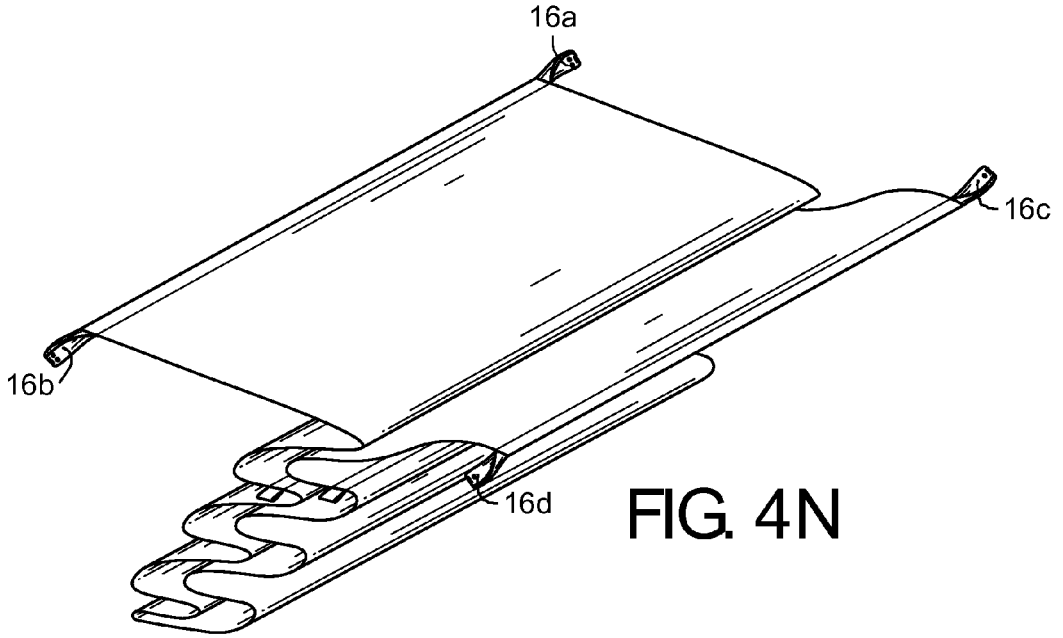
Figure 4O:
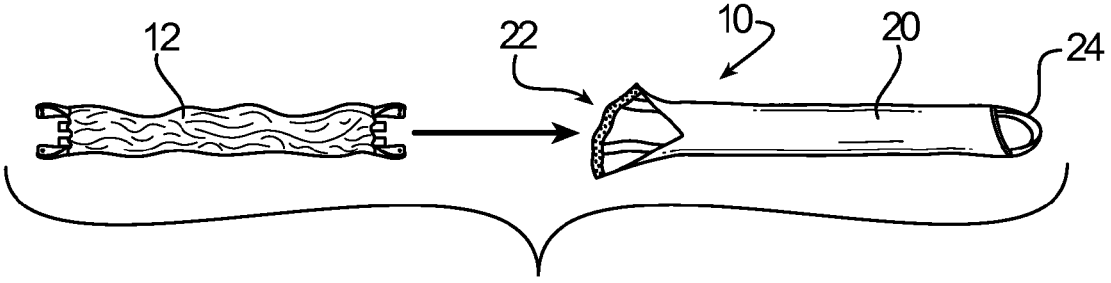
FIGS. 4O-4Q illustrate an exemplary method for inserting the corrugated sheet of FIGS. 4A-4L into a bag.
Figure 4P:
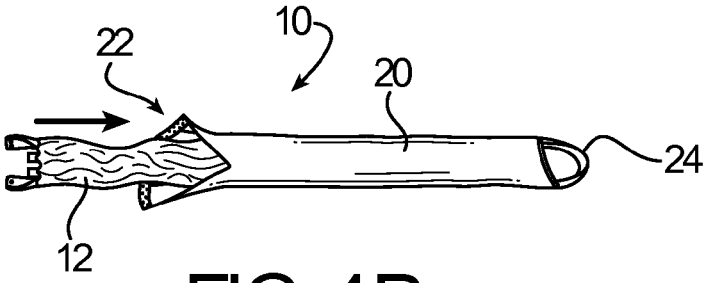
Figure 4Q:
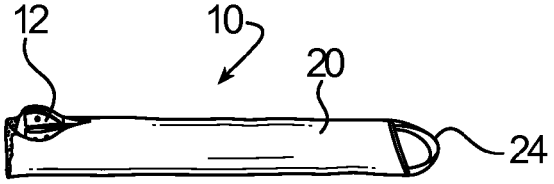

FIGS. 4A-4Q illustrate a method of preparing the patient transfer assembly 10 for use. First, the sheet 12 is corrugated by repeatedly folding the sheet 12 into a series of non-overlapping ridges and furrows. Care must be taken so that the sheet 12 is corrugated in a non-overlapping way such that the corrugated sheet 12 as shown in FIG. 4L is readily extendable under the patient as explained in detail below. FIGS. 4M and 4N illustrate two examples of ways in which the sheet 12 may be corrugated. The corrugation illustrated in FIG. 4M may be described as an accordion-like corrugation. The corrugation illustrated in FIG. 4N is another example possibility for corrugation of the sheet 12. Notice that in either example pulling of the handles 16*a* and 16*b* in a longitudinal direction away from the sheet 12 and the handles 16*c* and 16*d* in the opposite longitudinal direction effectively decorrugates or extends the sheet 12.

In one embodiment, the corrugated sheet 12 is retained corrugated by securing the sheet 12 at, for example, each end with straps (not shown) that may include a snap button, Velcro®, etc. or may simply be tied to hold the sheet 12 corrugated.

In one embodiment, the patient transfer assembly 10 is comprised of the elements described so far and used in the configuration illustrated in FIG. 4L. In the embodiment of FIGS. 4O-4Q, the patient transfer assembly 10 includes a bag 20 to store the corrugated sheet 12. The bag 20 includes an opening 22 through which the sheet 12 may be inserted into the bag 20 as shown in the progression of FIGS. 4O to 4Q. The bag 20 may also include a handle 24 to be used when deploying the patient transfer assembly 10 as explained below. Similar to the sheet 12, the bag 20 is constructed of a material that has a relatively low coefficient of drag or friction (i.e., the material is slippery). For example, the sheet 12 may be constructed of nylon, silicon coated nylon, Tyvek®, etc. In the illustrated embodiment (see FIG. 4O), the bag 20 is separate from the sheet 12 prior to insertion of the sheet 12 into the bag 20. In another embodiment (not shown), the bag 20 could be attached to or be an integral part of (integrated with) the sheet 12.

In one embodiment, single or multiple stiffeners 19 may be, instead of or in addition to at the ends or other locations of the sheet 12, attached to the bag 20. Or the stiffeners 19 may be unattached to the sheet 12 or the bag 20 and may simply be inserted in the bag 20 together with the sheet 12.

FIGS. 5A-5D illustrate deployment of the patient transfer assembly 10 to transfer a patient P who is resting on a surface S1 of a resting device D1.

Figure 5A:
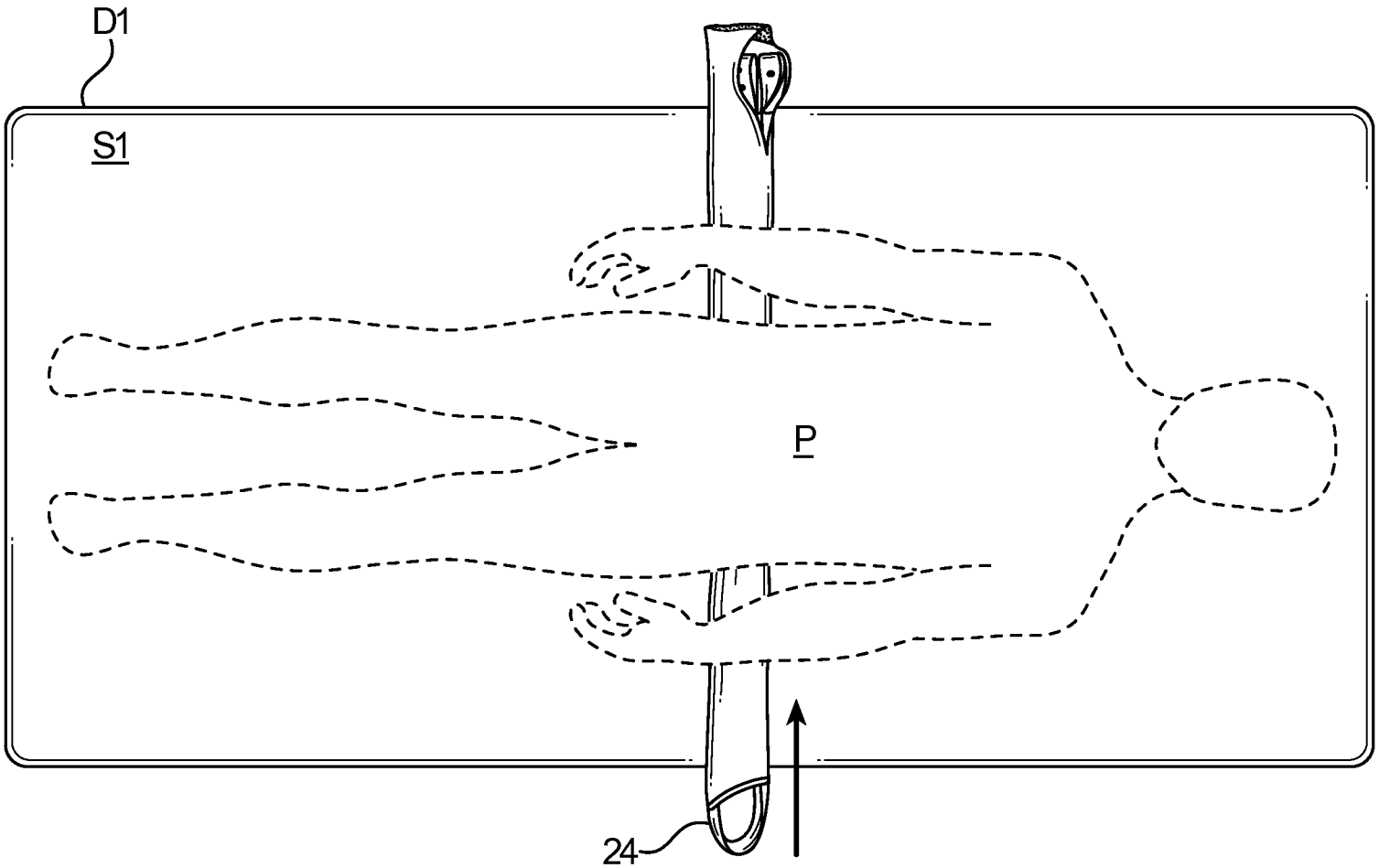
FIGS. 5A-5E illustrate an exemplary method for inserting and expanding the corrugated sheet of FIGS. 4A-4L under a patient.

As shown in FIG. 5A, the patient transfer assembly 10 including the corrugated sheet 12 and the bag 20 are first inserted into a channel formed between the patient P and the first resting surface S1. The channel between the patient P and the first resting surface S1 ideally corresponds to the lumbar region, lower torso, or lower back region of the patient P. This region of the body tends to arch up into the body forming a channel between the patient P and the first resting surface S1. The stiffeners 19 described above resist corrugation of the sheet on the sheet's lateral dimension; that is, the stiffeners 19 maintain the patient transfer assembly 10 stiff through the insertion into the channel formed between the patient P and the first resting surface S1.

In some cases, the channel formed between the patient P and the surface S1 may need to be expanded or even created to fit the patient transfer assembly 10. In those cases, the stiffness of the patient transfer assembly 10 due to the stiffeners 19 may help displace the surface S1 (e.g., a mattress) to aid in the insertion of the patient transfer assembly 10. Since the stiffeners 19 make the patient transfer assembly 10 including the bag 20 stiff and the bag 20 is constructed of a material that has a relatively low coefficient of drag or friction (i.e., the material is slippery), insertion of the patient transfer assembly 10 under the patient through the channel formed by the patient's lumbar region, lower torso, or lower back region should be relatively easy and should cause the patient very little, if any, discomfort.

Figure 5B:
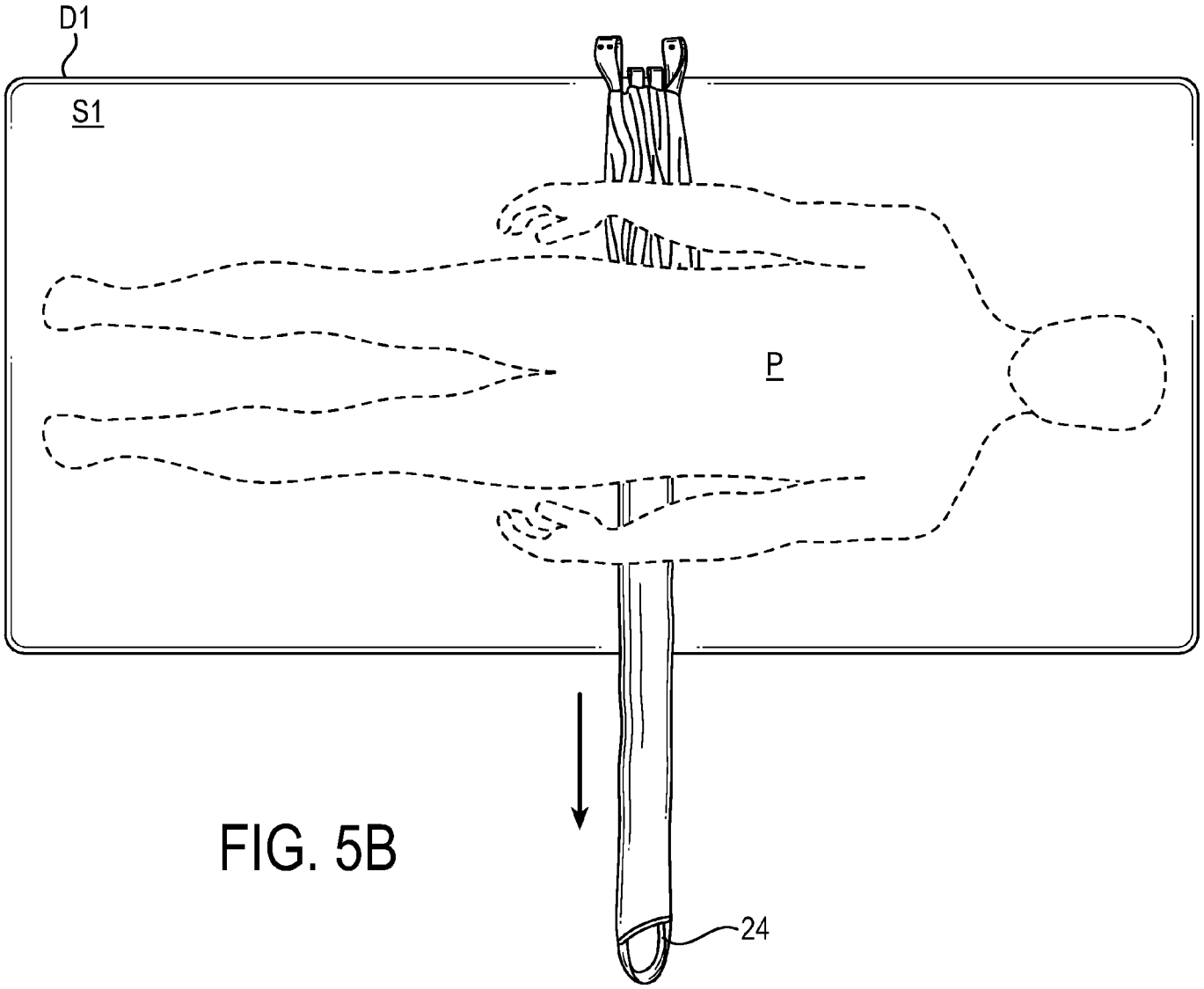
Figure 5C:
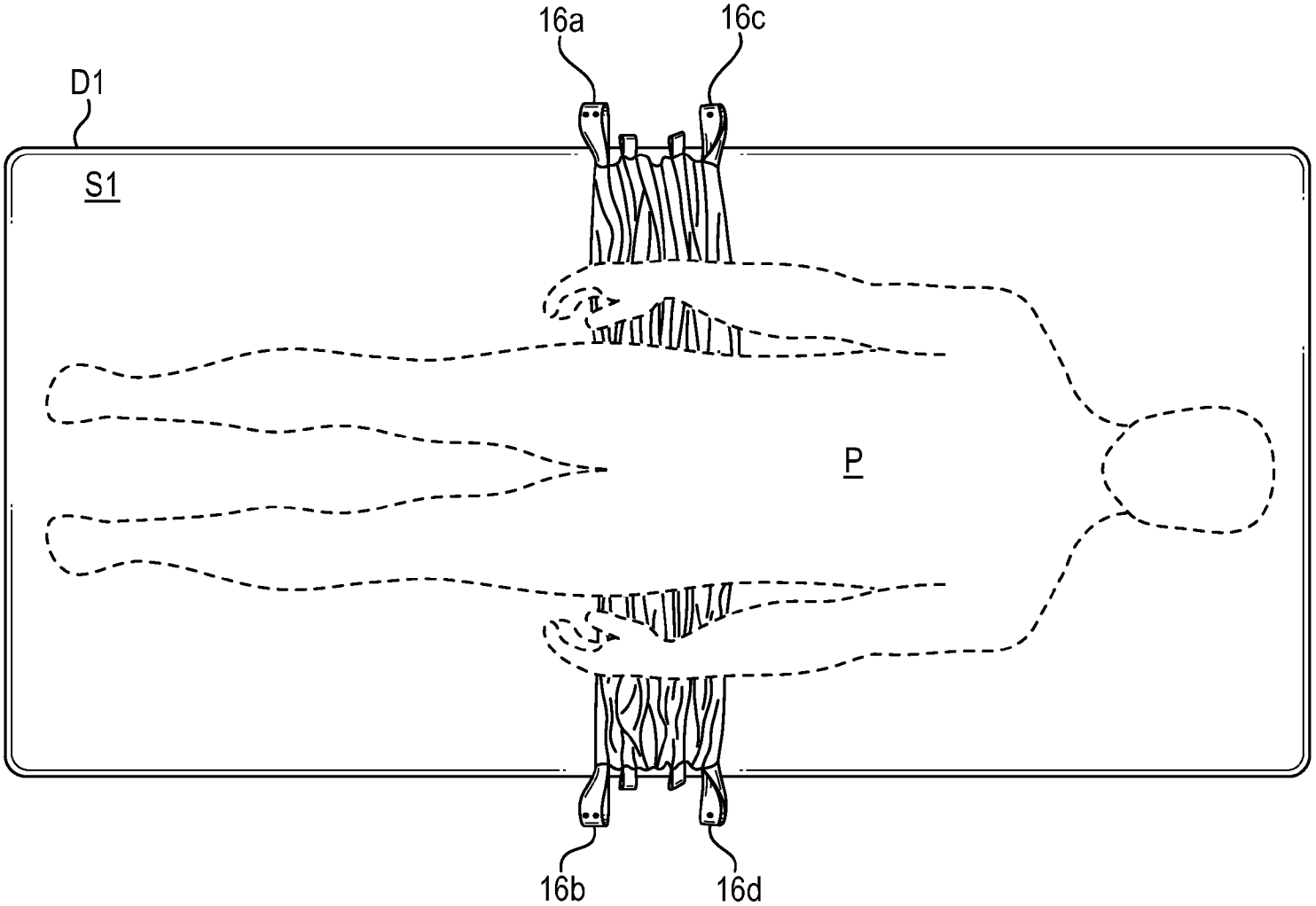

As shown in FIG. 5B, once the patient transfer assembly 10 including the bag 20 has been inserted between the patient P and the first surface S1, the bag 20 may be removed from between the patient P and the first surface S1 while the sheet 12 exits the bag through the opening 22 so that the sheet 12 remains between the patient P and the first surface S1. The handle 24 may be used to pull the bag 20 to remove the bag 20 from the channel while retaining the corrugated sheet 12 in place as shown in FIG. 5C.

In the embodiment of FIGS. 5A-5B, the patient transfer assembly 10 is shown as including the bag 20. However, as disclosed above, in other embodiments, the patient transfer assembly 10 may not include the bag 20. In such embodiments, it is the corrugated sheet 12 alone, as shown in FIG. 5C, that is inserted in the channel formed between the patient P and the first resting surface S1.

Figure 5D:
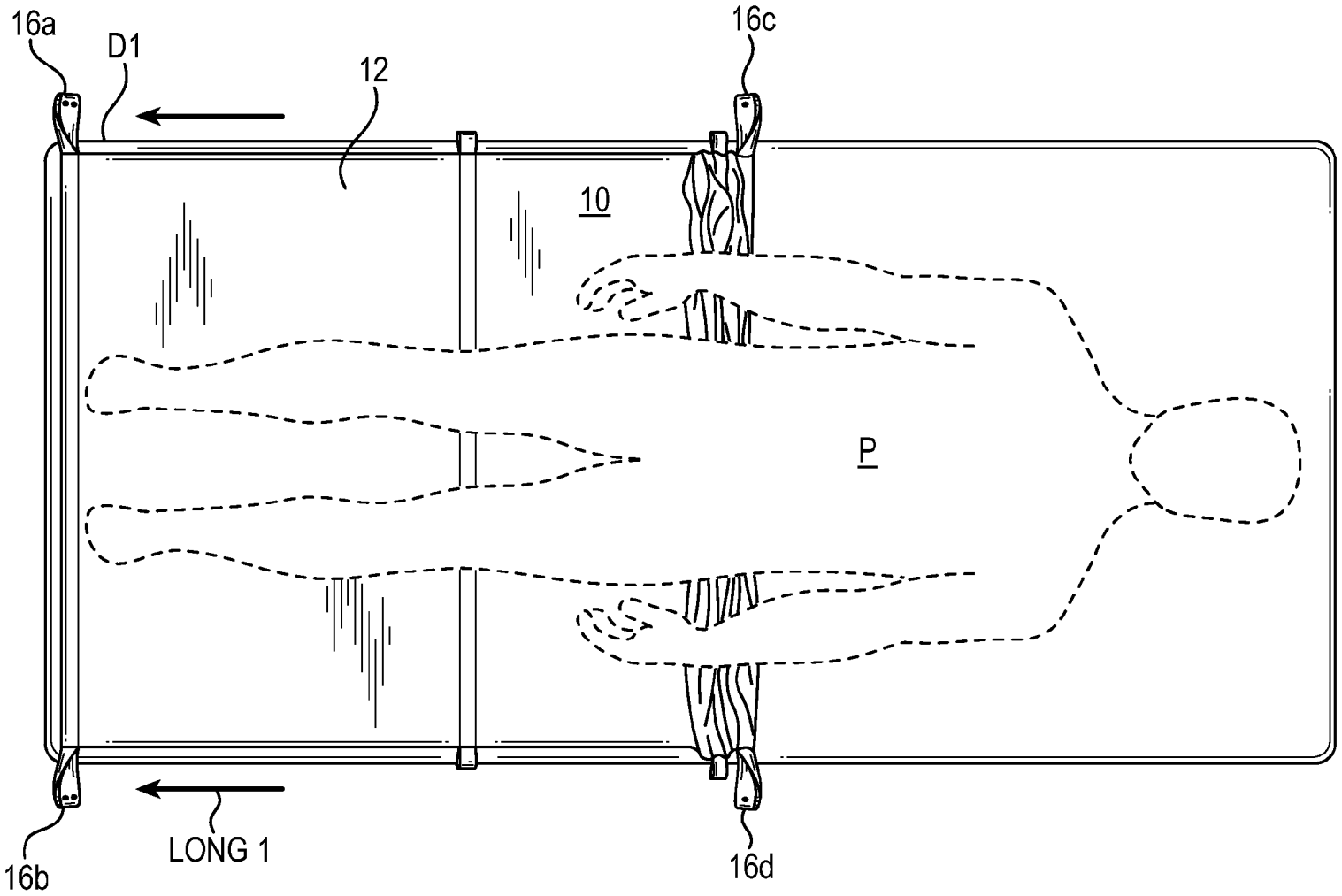
Figure 5E:
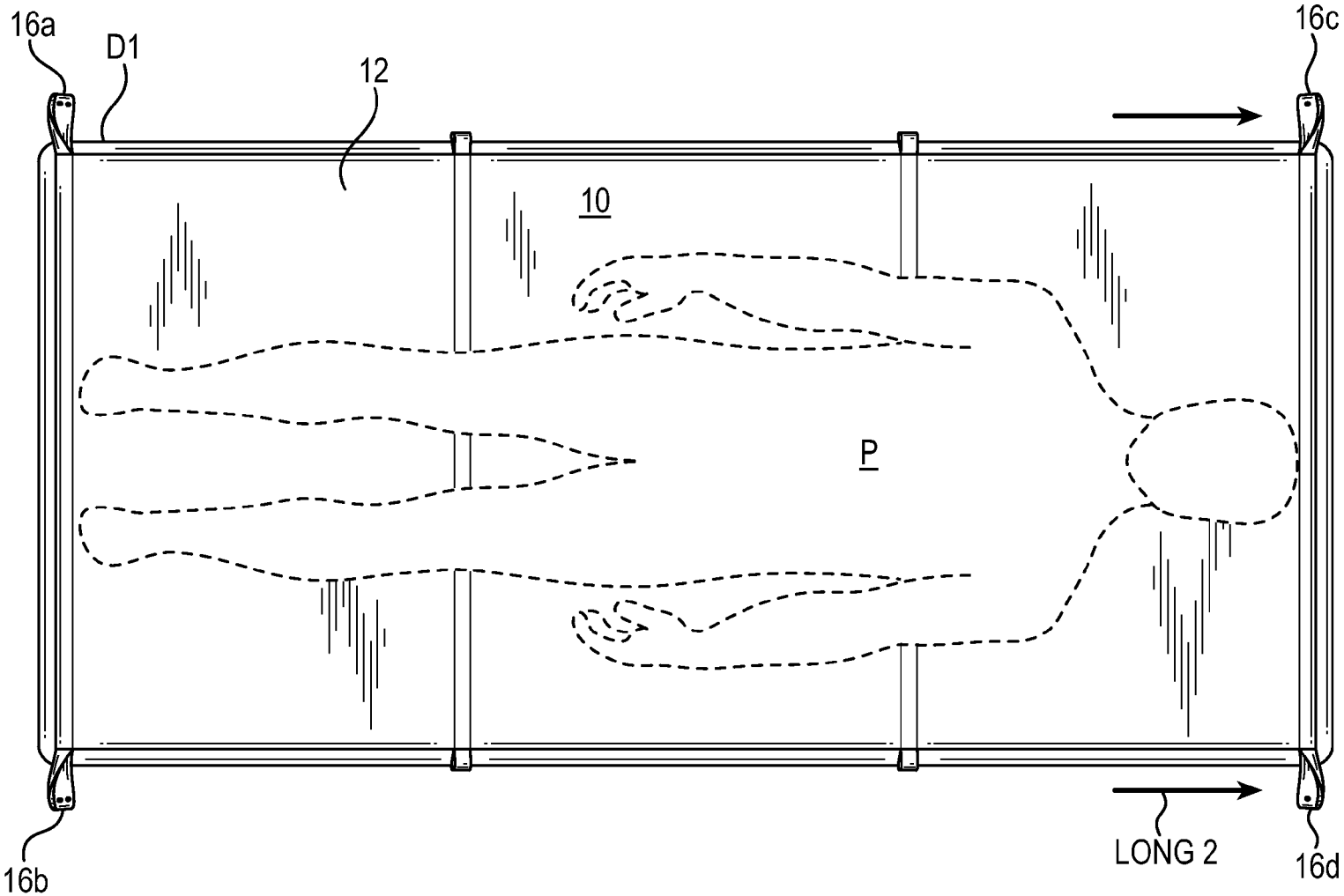
Figure 6A:
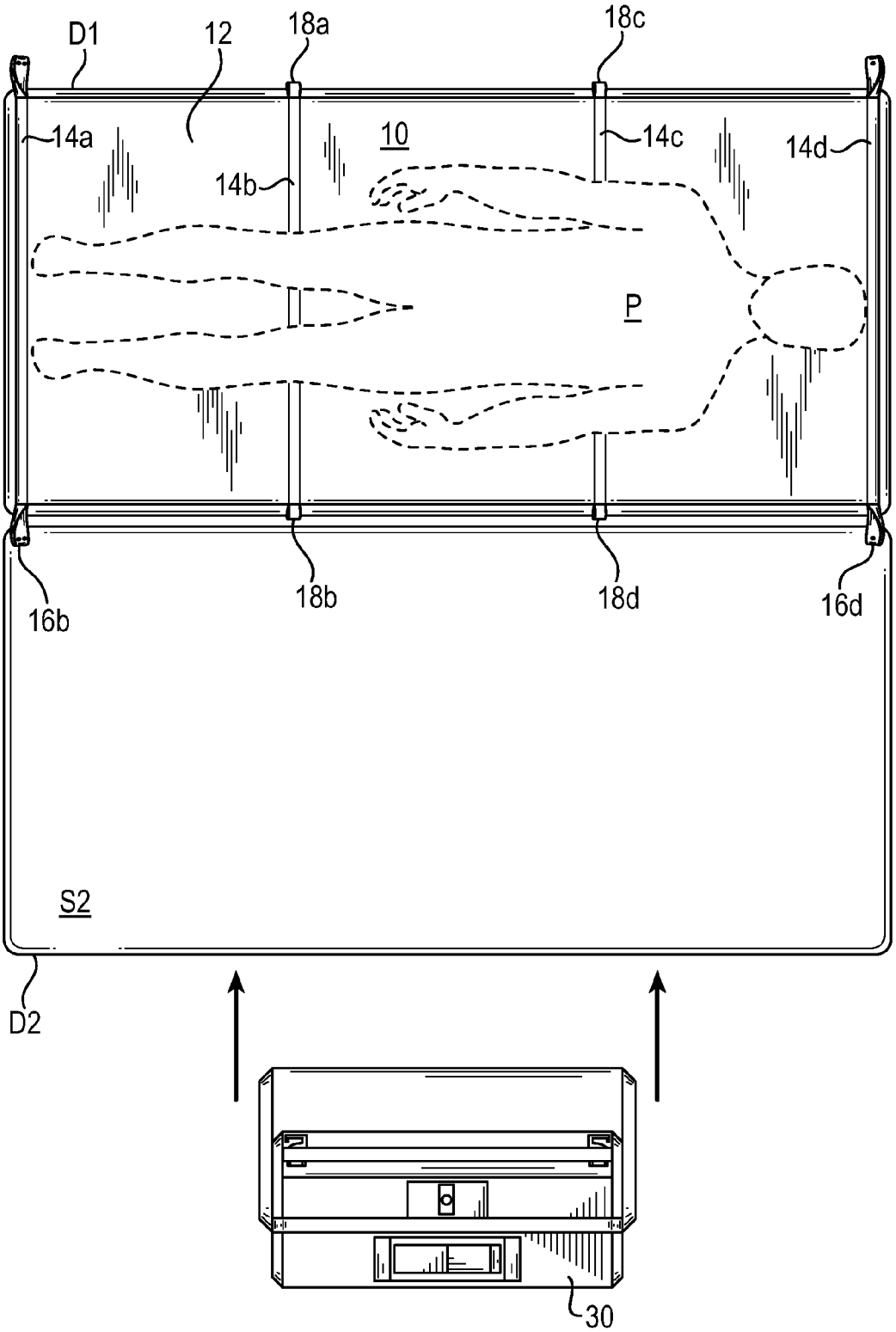
FIGS. 6A-6D illustrate an exemplary method for transferring a patient from a first resting device to a second resting device.
Figure 6B:
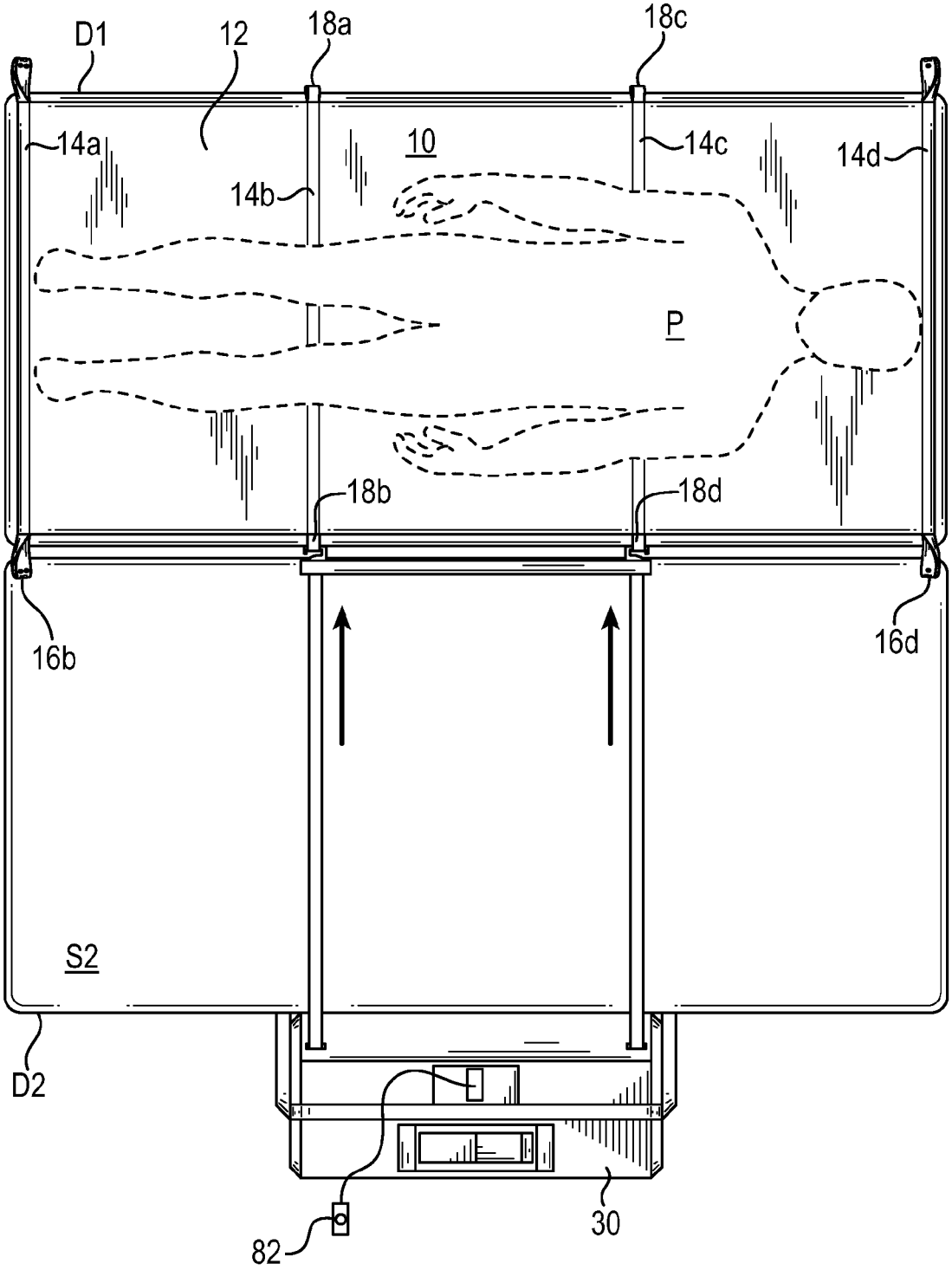
Figure 6C:
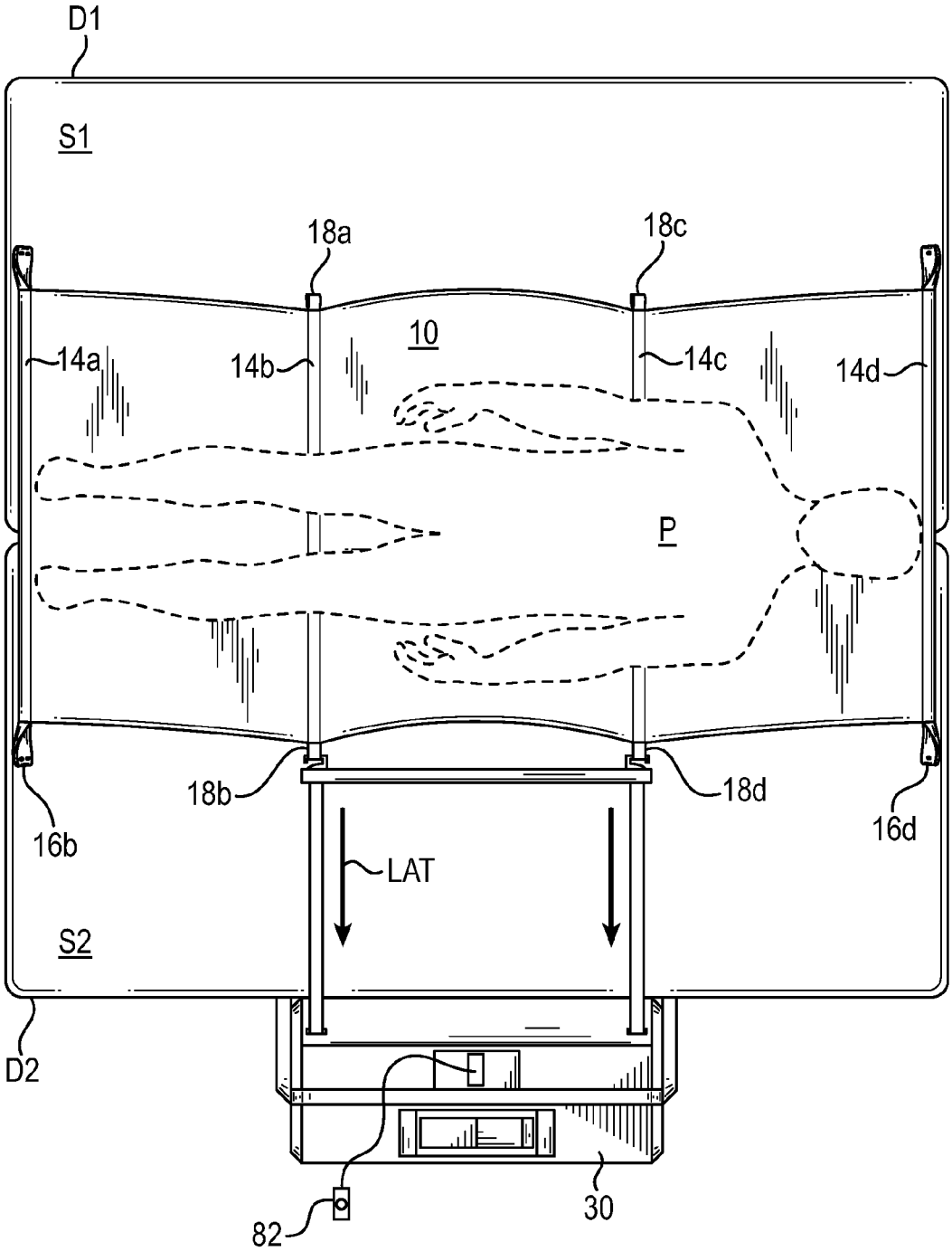
Figure 6D:
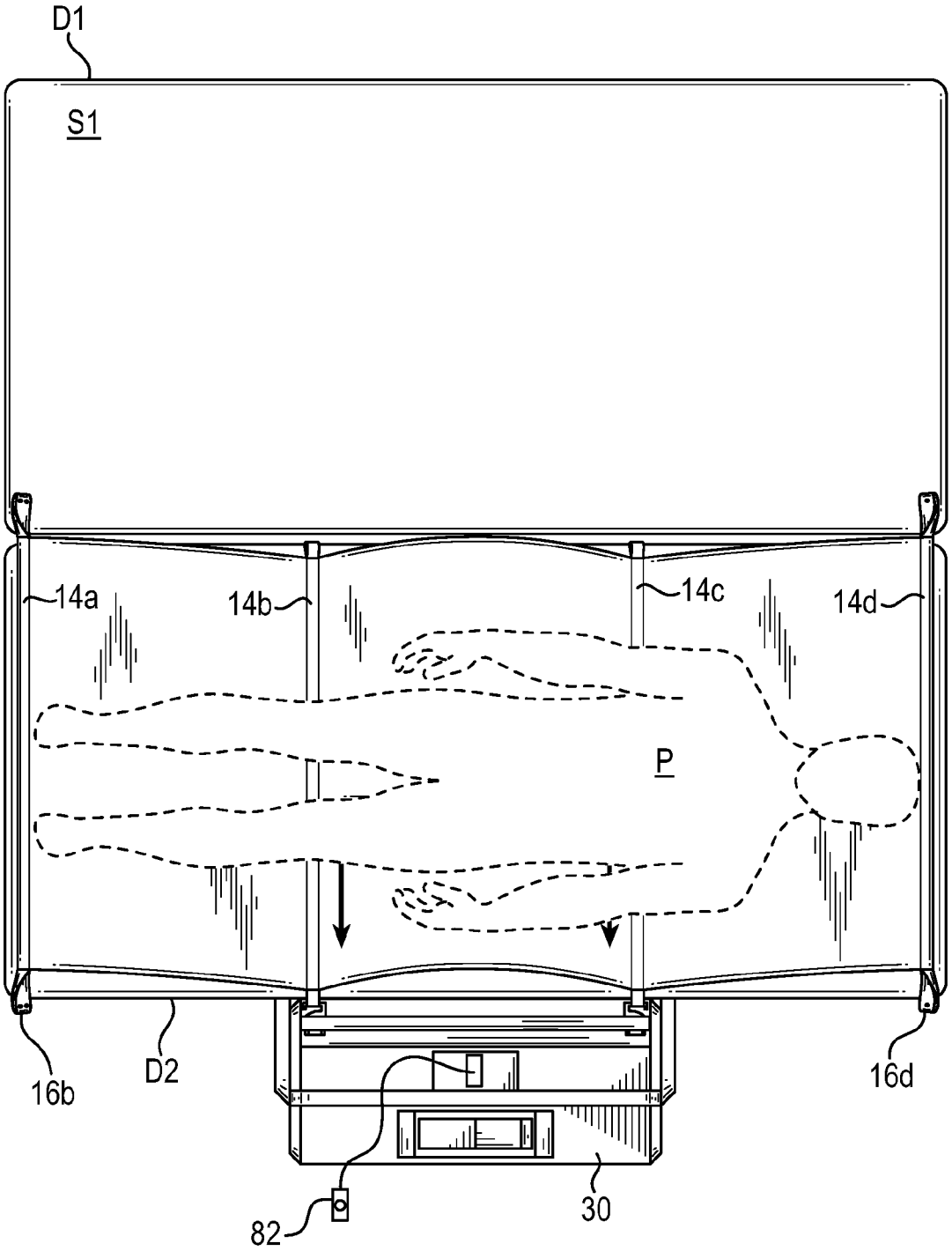

As shown in FIG. 5D, the sheet 12 is decorrugated under the patient P by extending a portion of the sheet 12 between the patient P and the first resting surface S1 to under the patient's feet. For example, the handles 16*a* and 16*b* may be used to pull on the sheet 12 along a longitudinal direction LONG 1. Similarly, as shown in FIG. 5E, the sheet 12 is decorrugated under the patient P by extending a portion of the sheet 12 between the patient P and the first resting surface S1 to under the patient's head. For example, the handles 16*c* and 16*d* may be used to pull on the sheet 12 along a longitudinal direction LONG 2. Since the sheet 12 is constructed of a material that has a relatively low coefficient of drag or friction (i.e., the material is slippery), decorrugation of the sheet 12 under the patient P should be relatively easy and should cause the patient very little, if any, discomfort.

In the illustrated embodiments and as shown in more detail in FIGS. 2 and 3, handles intended to be pulled towards one direction are marked differently from handles intended to be pulled in the opposite direction. For example, handles intended to be pulled towards one direction (e.g., the patient's head) may be marked with a single dot and handles intended to be pulled in the opposite direction (e.g., towards the patient's feet) may be marked with two dots. Marking as described should reduce the chance that the handles are crisscrossed by mistake.

As shown in the progression of FIGS. 6A-6D, after the sheet 12 has been decorrugated or extended under the patient P, the patient may be transferred from the surface S1 of the first resting device D1 to the surface S2 of the second resting device D2 by pulling laterally on the patient transfer assembly 10 to slide the sheet 12 from the first resting surface S1 to the second resting surface S2.

Pulling laterally of the patient transfer assembly 10 to transfer the patient P may be done by a machine or patient transfer device 30 as illustrated or by health care workers or other people depending mostly on availability of the device 30 and the weight of the patient P. Where a patient transfer device 30 is used, the device 30 may engage the patient transfer assembly 10 at the fasteners 18. Where health care workers or other people perform the transfer, they may pull the patient transfer assembly 10 from the general area of the fasteners 18 or the handles 16. Pulling laterally at these positions on the patient transfer assembly 10 in a direction substantially parallel to the first surface S1 should distribute the pulling force to portions of the sheet 12 on which a majority of the weight of the patient P rests allowing for transfer of the patient P on the sheet 12. Since the sheet 12 is constructed of a material that has a relatively low coefficient of drag or friction (i.e., the material is slippery), transfer of the patient P should be relatively easy and should cause the patient very little, if any, discomfort.

The patient transfer assembly 10 may remain in place under the patient P or it may be removed from under the patient P by pulling up on the sheet 12 or the handles 16 with a force or speed that creates moment and thus significantly reduces friction between the sheet 12 and the patient P. The sheet 12 may be pulled in a direction that is non-parallel with the surface S2 such that the sheet 12 slips from under the patient P without carrying the patient P.

While example systems, methods, and so on, have been illustrated by describing examples, and while the examples have been described in considerable detail, it is not the intention to restrict or in any way limit the scope of the appended claims to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, and illustrative examples shown or described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (3D. Ed. 1995).

What is claimed is:

1. A patient transfer assembly comprising:

a sheet of corrugatable material, the sheet having a longitudinal dimension, a transverse dimension perpendicular to the longitudinal dimension of the sheet, and at least one longitudinal edge extending along the longitudinal dimension of the sheet;

at least one elongated stiffener disposed in relation to the sheet extending along the transverse dimension of the sheet to resist corrugation of the sheet in the transverse dimension of the sheet when the patient transfer assembly including the sheet corrugated in the longitudinal dimension of the sheet is inserted between the patient and a surface of a first resting device on which the patient rests;

wherein the sheet includes portions at which pulling in a direction along the longitudinal dimension of the sheet decorrugates the sheet between the patient and the surface along a longitudinal axis of the patient extending from the patient's head to the patient's feet; and fasteners disposed at positions of the sheet such that pulling of at least one of the fasteners in a direction along the transverse dimension of the sheet slides the decorrugated sheet relative to the surface thereby transferring the patient along a transverse axis of the patient perpendicular to the longitudinal axis of the patient;

wherein the patient transfer assembly is operable to at least two configurations including:

a corrugated configuration in which the sheet is corrugated along the longitudinal dimension of the sheet and in which the entire at least one longitudinal edge of the sheet converges such that the patient transfer assembly in the corrugated configuration is configured to be inserted along the transverse axis of the patient into a channel under the patient between the patient and the surface on which the patient rests, and a decorrugated configuration in which the sheet is decorrugated under the patient and in which the at least one longitudinal edge of the sheet extends along the longitudinal axis of the patient, wherein the patient transfer assembly is operable from the corrugated configuration to the decorrugated configuration while the sheet remains under the patient.

2. The patient transfer assembly of claim 1 comprising:

a bag in which the sheet corrugated in the second dimension is stored to form a sheet/bag combination, the at least one stiffener disposed in relation to the bag to resist corrugation of the sheet/bag combination in the first dimension when the patient transfer assembly is inserted between the patient and the surface on which the patient rests.

3. The patient transfer assembly of claim 1 comprising:

a bag in which the sheet corrugated in the second dimension is stored to form a sheet/bag combination, the at least one stiffener disposed in relation to the bag to resist corrugation of the sheet/bag combination in the first dimension when the patient transfer assembly is inserted between the patient and the surface on which the patient rests, wherein the at least one stiffener is at least one of:

attached to the bag, attached to the sheet, or inserted in the bag unattached to the bag or the sheet.

4. The patient transfer assembly of claim 1 comprising:

a bag in which the sheet corrugated in the second dimension is stored to form a sheet/bag combination, the bag having an opening at one end through which the sheet is inserted to form the sheet/bag combination and a handle at a second end opposite the first end, the at least one stiffener disposed in relation to the bag to resist corrugation of the sheet/bag combination in the first dimension when the patient transfer assembly is inserted between the patient and the surface on which the patient rests, the bag's opening and the bag's handle configured for, after the patient transfer assembly is inserted between the patient and the surface on which the patient rests, the handle to be pulled so that the bag is removed from between the patient and the surface on which the patient rests while the sheet exits the bag through the opening to remain between the patient and the surface on which the patient rests.

5. The patient transfer assembly of claim 1, wherein the portions at which pulling in a direction along the second dimension decorrugates the sheet between the patient and the surface have handles attached thereon, and wherein pulling of at least some of the handles in the direction along the second dimension extends the sheet between the patient and the surface from under a middle portion of the patient's body to under the patient's head and feet.

6. The patient transfer assembly of claim 1, wherein the portions at which pulling in a direction along the second dimension decorrugates the sheet between the patient and the surface have at least some handles attached thereon, wherein pulling of at least some of the handles in the one direction along the second dimension extends the sheet between the patient and the surface from under a middle portion of the patient's body to under the patient's head and feet and wherein handles, from the at least some of the handles, intended to be pulled towards the head are marked differently from handles, from the at least some of the handles, intended to be pulled towards the feet.

7. The patient transfer assembly of claim 1, wherein the portions at which pulling in a direction along the second dimension decorrugates the sheet between the patient and the surface have at least some handles attached thereon, wherein pulling of the at least some of the handles in the at least one direction along the second dimension extends the sheet between the patient and the surface to a first direction along the second dimension and to a second direction along the second dimension and opposite the first direction, and wherein handles, from the at least some of the handles, intended to be pulled towards the first direction are marked differently from handles, from the at least some of the handles, intended to be pulled towards the second direction.

* * * * *